US005389962A

United States Patent [19]

Sekiya et al.

[11] Patent Number: 5,389,962

[45] Date of Patent: Feb. 14, 1995

[54] INK JET RECORDING HEAD ASSEMBLY

[75] Inventors: Takuro Sekiya; Mitsuru Shingyouchi; Takashi Kimura, all of Yokohama; Takayuki Yamaguchi, Minoo; Yoshio Watanabe, Kawasaki; Shuji Motomura, Yokohama; Eiko Suzuki, Sagamihara; Masami Kadonaga, Yokohama, all of Japan

[73] Assignee: Ricoh Company, Ltd., Tokyo, Japan

[21] Appl. No.: 803,561

[22] Filed: Dec. 9, 1991

[30] Foreign Application Priority Data

| | | | |
|---|---|---|---|
| Dec. 14, 1990 | [JP] | Japan | 2-410976 |
| Apr. 15, 1991 | [JP] | Japan | 3-110911 |
| Jul. 5, 1991 | [JP] | Japan | 3-192442 |
| Aug. 28, 1991 | [JP] | Japan | 3-242726 |

[51] Int. Cl.[6] ..... B41J 2/05; B41J 2/175

[52] U.S. Cl. ..... 347/65; 347/46; 347/85

[58] Field of Search ..... 346/140 R; 347/46, 65, 347/85

[56] References Cited

U.S. PATENT DOCUMENTS

| | | | |
|---|---|---|---|
| 4,312,009 | 1/1982 | Lange | 346/140 R |
| 4,394,670 | 7/1983 | Sugitani | 346/140 R |
| 4,410,899 | 10/1983 | Haruta | 346/140 R |
| 4,503,444 | 4/1985 | Tacklind | 346/140 R |
| 4,580,148 | 4/1986 | Domoto | 346/140 R |
| 4,596,994 | 6/1986 | Matsuda | 346/140 R |
| 4,942,408 | 7/1990 | Braun | 346/140 R |
| 4,980,703 | 12/1990 | Sakurai | 346/140 R |

FOREIGN PATENT DOCUMENTS

| | | | |
|---|---|---|---|
| 0389738 | 10/1990 | European Pat. Off. | B41J 2/14 |
| 3322647 | 12/1983 | Germany | B41J 2/14 |
| 3402680 | 8/1984 | Germany | B41J 3/04 |
| 3618596 | 12/1986 | Germany | B41J 3/04 |
| 61-249768 | 11/1986 | Japan | B41J 3/04 |
| 249768 | 11/1986 | Japan . | |
| 50150 | 3/1987 | Japan . | |
| 101157 | 4/1989 | Japan | B41J 3/04 |
| 2-155652 | 6/1990 | Japan | B41J 2/05 |

OTHER PUBLICATIONS

Patent Abstracts of Japan, M-576, Mar. 31, 1978, English-language Abstract of Japanese Laid-Open Patent Application No. 61-249768.

Patent Abstracts of Japan, Abstract of Japanese Laid-Open Patent No. 2-155652, vol. 14, No. 407, Sep. 4, 1990, p. M-1019.

Patent Abstracts of Japan, Abstract of Japanese Laid-Open Patent No. 1-180352, vol. 13, No. 462, Oct. 19, 1989, p. M-881.

*Primary Examiner*—Joseph W. Hartary

*Attorney, Agent, or Firm*—Cooper & Dunham

[57] ABSTRACT

An ink jet recording head assembly includes: a base member having a plurality of enclosures, a top of each of the enclosures having an opening; a mechanism for supplying ink to each of the enclosures via the opening at the top thereof and for maintaining the ink at a predetermined depth; and a heater element which is provided in each of the enclosures under the ink supplied via the opening, the heater element heating the ink in each of the enclosures so that a bubble is generated in the ink; wherein an ink drop is jetted from a surface of the ink due to the bubble generated in the ink.

19 Claims, 11 Drawing Sheets

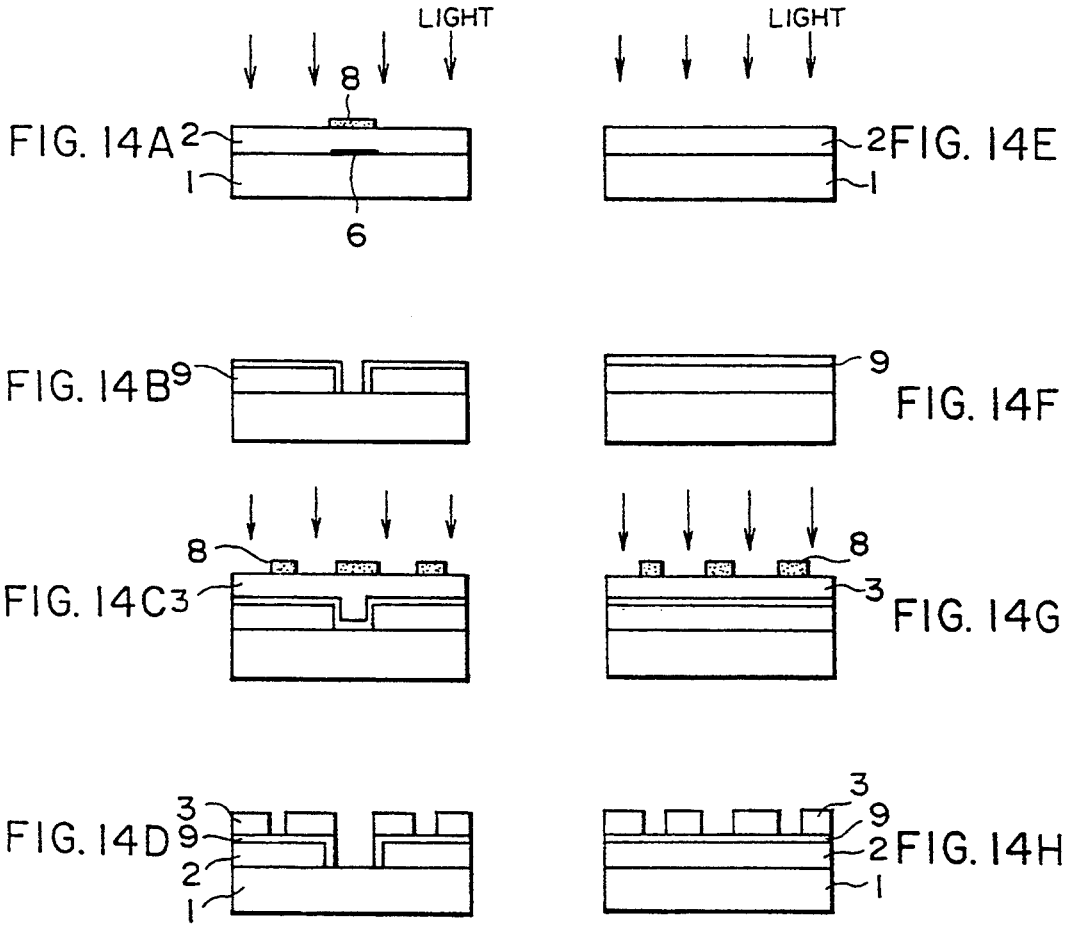
FIG. 15A
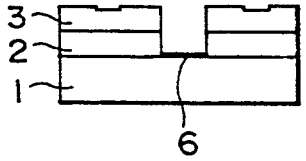
FIG. 15B
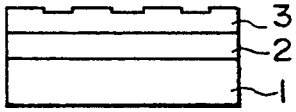

INK JET RECORDING HEAD ASSEMBLY

BACKGROUND OF THE INVENTION (1) Field of the Invention

The present invention generally relates to an ink jet recording head, a method for jetting an ink from such and a method for forming an ink jet recording head , and particularly to an ink jet recording head and a method for jetting an ink from such in which the ink can be accurately jetted from the ink jet recording head and a fine dot image can be formed on a recording sheet, and a method for forming an ink jet recording head in which the ink jet recording head can be accurately and easily formed at a low cost.

Conventionally, various methods and apparatus for forming an image on a recording sheet by jetting ink drops have been proposed.

U.S. Pat. Nos. 3,060,429, 3,596,275 and 3,416,153 disclose methods for forming a dot image in which ink dots are jetted by use of an electrostatic force. A method disclosed in U.S. Pat. No. 3,060,429 is often referred to as a Tele-type method, a method disclosed in U.S. Pat. No. 3,596,257 is often referred to as a Sweet method, and a method disclosed in U.S. Pat. No. 3,416,153 is often referred to as a Hertz method.

U.S. Pat. No. 3,747,120 discloses a method, often referred to as a Stemme method, in which the ink drops are jetted from orifices by use of a vibration mechanism such as a piezo-electric device.

Other methods for jetting ink drops by use of bubbles generated in the ink have also been proposed. For example, U.S. Pat. No. 4,580,148 discloses a method for jetting the ink drops in which, after a bubble has reached its maximum growth, the ink drop is jetted from the surface of the ink layer by a force which is generated when the bubble is quickly collapsed. In this method, when the bubble is quickly collapsed, small ink drops (mist) other than the primary ink drop can be easily generated. Thus, the quality of a dot image formed on the recording sheet easily deteriorates.

U.S. Pat. Nos. 4,558,333, 4,683,481, 4,794,410 and 4,882,595 disclose structures of an ink jet recording head in which ink drops are jetted therefrom by use of bubbles. In this type of the ink jet recording head, a heater element is surrounded by walls, and the bubble is generated in the ink on the heater element by heat of the heater element. The ink drop is jetted in a direction perpendicular to the heater element by the force of the growth of the bubble. However, in the ink jet recording head disclosed in the above references, an orifice plate having orifices is mounted on the walls so that each of the orifices faces the heater element. Each of these orifices can be obstructed by the ink whose viscosity is increased. In addition, the ink is supplied to inside the walls via flow ports which are formed between the walls. Thus, when the bubble grows, a part of the ink on the heater element flows toward the outside of the walls via the flow ports by the propulsion force of the bubble. That is, it is difficult to efficiently jet drops.

SUMMARY OF THE INVENTION

Accordingly, a general object of the present invention is to provide a novel and useful ink jet recording head, a method for jetting ink drops by such, and a method of forming the ink jet recording head in which the disadvantages of the aforementioned prior art are eliminated.

A more specific object of the present invention is to provide an ink jet recording head and a method of jetting ink drops in which the ink drops can be effectively jetted from the ink jet recording head.

The above objects of the present invention are achieved by an ink jet recording head assembly comprising: a base member having a plurality of enclosures, a top of each of the enclosures having an opening; means for supplying ink to each of the enclosures via the opening and for maintaining the ink at a predetermined depth; and an energy operation portion which is provided in each of the enclosure so as to be put under the ink supplied via the opening, the energy operation portion supplying energy to the ink in each of the enclosures so that a bubble is generated in the ink; wherein an ink drop is jetted by growth of the bubble from a surface of the ink.

The above objects of the present invention are also achieved by a method for jetting an ink drop from an ink jet recording apparatus assembly which comprises a base member having a plurality of enclosures, a top of each of the enclosures having an opening, means for supplying ink to each of the enclosures via the opening and for maintaining the ink at a predetermined depth, an energy operation portion which is provided in each of the enclosure so as to be put under the ink supplied via the opening, and the energy operation portion supplying energy to the ink in each of the enclosures so that a bubble is generated in the ink, the method comprising the steps of: (a) generating a bubble in the ink in each of the enclosures to which the energy is supplied by the energy portion in accordance with image data; (b) making the bubble grow until the bubble reaches a predetermined size; (c) contracting the bubble under a condition in which the energy portion is turned off; and (d) making the bubble disappear into the ink, wherein an ink column projects from the surface of the ink, the ink column being separated from the 10 surface of the ink and then a ink drop being jetted from the ink, due to a propulsion force generated by growth of the bubble.

According to the present invention, as the bubble is generated in each of the enclosures into which no ink flows from the side thereof, the propulsion force generated by the growth of the bubble is effectively transmitted toward the opening of each of the enclosures. Thus, the ink drop can be stably jetted from the ink jet recording head assembly.

Another object of the present invention is to provide an ink jet recording head in which the depth of the ink layer therein can be easily and accurately controlled at a constant value.

Still another object of the present invention is to provide a method for forming the ink jet recording head by which the ink jet recording head can be easily formed in accordance with a photolithography process.

This object of the present invention is achieved by a method for forming an ink jet recording head assembly which comprises a heater base on which heater elements are provided, a first plate having pits, each of which corresponds to one of the heater elements of the heater base, and a second plate having a channel, the heater base, the first plate and the second plate being stacked in this order, and ink flowing through the channel and being supplied to the pits, the method comprising the steps of: (a) forming the heater elements on a substrate so that the heater base is made; (b) coating a first photoresist film on the heater base; (c) forming the pits on the first photoresist film by a photolithography process so that each of the pits corresponds to one of the heater elements of the heater base, by which process the first plate is formed of the first photoresist film; (d) forming a metal layer on the first photoresist film; (e) coating a second photoresist film on the metal layer; and (f) forming the channel on the second photoresist film by the photolithography process, so that the second plate is formed of the second photoresist film.

According to the present invention, as the metal layer is formed between the first and second photoresist films, the first plate on which the heater elements are formed and the second plate on which the channel is formed can be made of the photoresist films by the photolithography process.

Additional objects, features and advantages of the present invention will become apparent from the following detailed description when read in conjunction with the accompanying drawings.

BRIEF DESCRIPTION OF THE DRAWINGS

FIGS. 14A–14H are diagrams illustrating process for forming the recording head chip.

FIGS. 15A and 15B are cross sectional views illustrating the structure of the recording head chip which is formed in accordance with another process.

DESCRIPTION OF THE PREFERRED EMBODIMENTS

A description will now be given of embodiments of the present invention with reference to FIGS. 1 through 6.

First a description will be given of a basic structure of an ink jet recording head unit.

Figure 1:
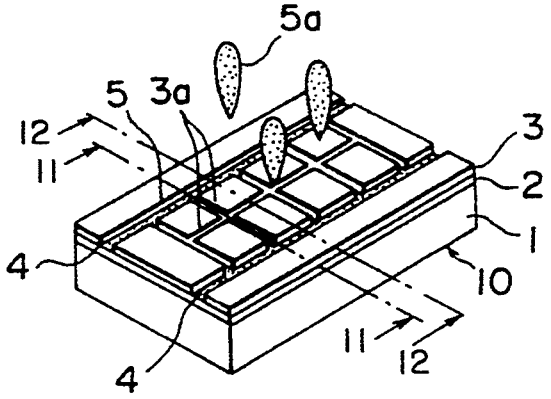
FIG. 1 is a perspective view of a recording head chip according to an embodiment of the present invention.
Figure 2A:
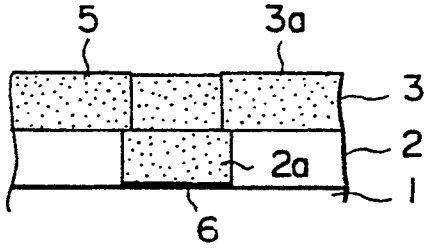
FIGS. 2A and 2B are cross sectional views taken along line A—A shown in FIG. 1.
Figure 2B:
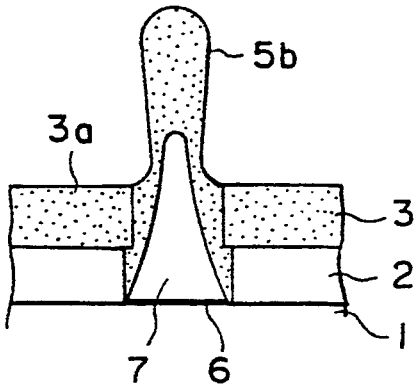

FIG. 1 shows an essential part of an ink jet recording head according to an embodiment of the present invention. In FIG. 1, for the sake of simplicity, the ink jet is shown as having only three heater elements (energy operating portions), and an ink supplier, a driver unit for driving the heater elements and so on are omitted. FIGS. 2A and 2B are cross sectional views taken along line 11—11 shown in FIG. 1. FIG. 2A indicates a steady state in which the heater elements are not driven, and FIG. 2B indicates a state in which the heater elements are driven. FIGS. 3A–3F show procedures for forming a recording head chip provided in the ink jet recording head.

Figure 3A:
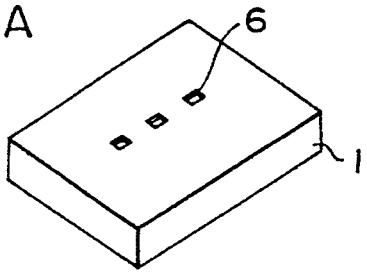
FIGS. 3A–3F are diagrams illustrating processes for forming the recording head chip.
Figure 3D:
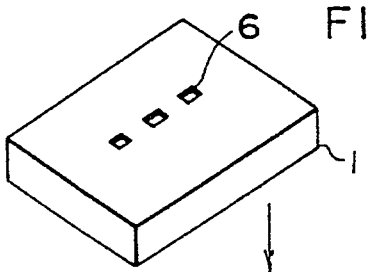

Referring to FIG. 1, a recording head chip has a heater base 1, a photoresist film 2 and an ink supplying plate 3, which are stacked in this order. The recording head chip is formed in accordance with a procedure shown, for example, in FIGS. 3A and 3C. A well known film forming technology, such as photolithography technology, etching technology or the like is applied to a substrate formed, for example, of Si wafer, glass, alumina or the like, so that the heater base 1 is formed. That is, the heater base 1 is formed by use of wafer processing technology. Heater elements 6 are formed on the heater base 1, as shown in FIG. 3A. The photoresist film 2 is coated on the heater base 1. Pits **2*a* are formed on the photoresist film 2 by the photolithography process so that each of the pits 2*a* corresponds to one of the heater elements 6. Each of the heater elements 6 is exposed from a corresponding one of the pits 2*a*. Each of the pits 2*a*** has a depth in a range between a few μm and tens of μm. Thus, a photoresist film having a thickness of approximately 1 μm, which is normally used for manufacturing an IC, cannot be used. In a case where a liquid photoresist material is coated on the substrate by a spin-coating process, the photoresist film having a thickness in a range of 10–40 μm can be formed on the substrate under conditions where a viscosity of the liquid photoresist material is in a range of 1000–2000 cp and a rotation speed of the spin coating process is in a rage of 500–1000 rpm. BMRS1000 manufactured by TOKYO OHKA Industrial CO., LTD. can be preferably used as the photoresist material.

The pits **2*a* can be formed on the photoresist film 2 by other processes. For example, after a dry photoresist film is laminated on the substrate, exposure and development processes are performed so that the pits 2*a* are formed on the photoresist film 2**. In this case, Ordyl SY 250 manufactured by TOKYO OHKA Industrial CO., LTD. can be used as the photoresist material.

Figure 3B:
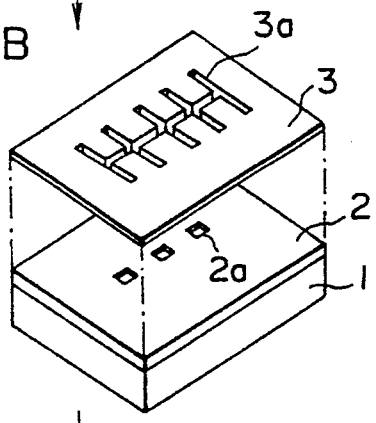

After the photoresist film 2 having the pits **2*a* is formed on the heater base 1 (the substrate), the ink supplying plate 3 having an ink channel 3*a* (a groove) as shown in FIG. 3B is adhered to the surface of the photoresist film 2. The ink suppling plate 3 having the ink channel 3*a*** is easily formed, for example, by etching a photosensitive glass. Each point at which ink channel segments (forming the ink channel 3*a*) cross each other on the ink supplying plate 3 corresponds to one of the pits 2*a*. The ink supplying plate 3 is adhered to the surface of the photoresist film 2 by making epoxy adhesive percolate between the ink supplying plate 3 and the photoresist film 2 by capillarity.

Figure 3E:
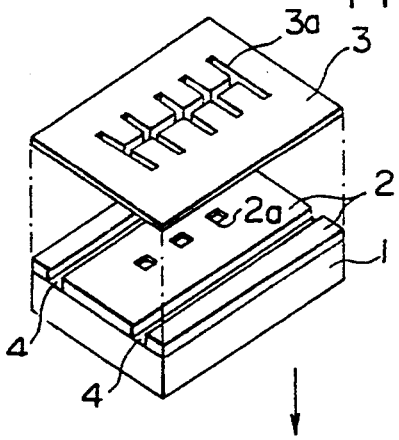
Figure 3C:
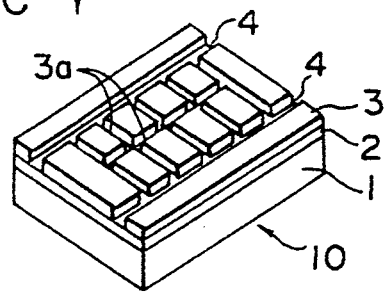

After the adhesive is cured, grooves 4 are formed on the ink supplying plate 3 to be connected to the ink channel 3*a* by using a dicing saw, as shown in FIG. 3C. Ink which is supplied to the ink jet recording head passes through the grooves 4 and fills the ink channel 3*a*.

Figure 3F:
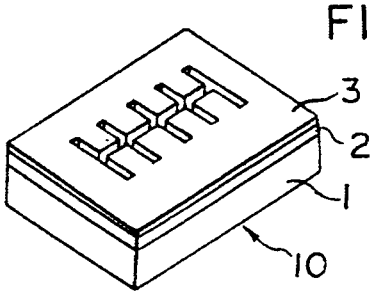

A process for forming the recording head chip is not limited to the above process. The recording head chip can be formed in accordance with a procedure shown in FIGS. 3D–3F. In this case, grooves 4 used for suppling ink are formed on the photoresist film 2 thereon by the photolithography process when the pits 2*a* are formed, as shown in FIG. 3E. After this, the ink supplying plate 3 having the ink channel 3*a* is adhered to the surface of the photoresist film 2 so that the grooves 4 of the photoresist film 2 and the ink channel 3*a* of the ink supplying plate 3 are connected to each other, as shown in FIG. 3F.

Further, in another example, after the pits are formed on the heater base 1, the photolithography process is performed again so that the ink channel 3*a* shown in FIG. 3C is formed. In this example, the ink channel used in the photolithography process, which is performed again, is deep, that is, the thickness of the photoresist film used in the photolithography process is thick. Thus, a liquid photoresist material having a high concavity or the dry photoresist film is used.

Figure 4A:
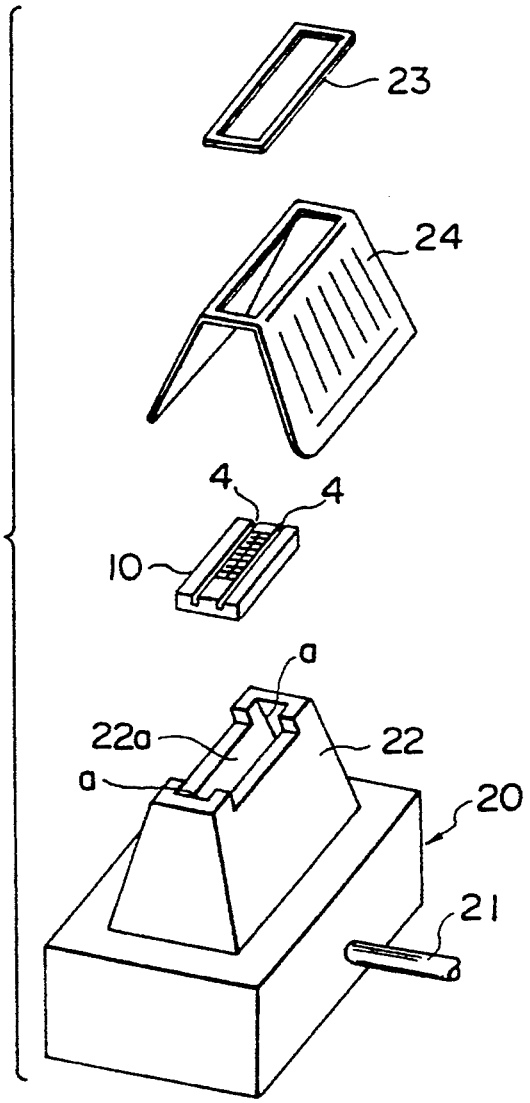
FIG. 4A is a exploded perspective view illustrating an ink jet recording head unit including the recording head chip shown in FIG. 1.

An ink jet recording head unit 20 comprises the recording head chip 10 made in accordance with the above process, as shown in FIG. 4A.

Referring to FIG. 4A, the ink jet recording head unit 20 has a trapezoidal-shaped manifold 22 as a base member. An ink supply chamber 22*a* is formed in the manifold 22. An ink supply tube 21 is connected to the ink supply chamber 22*a* of the manifold 22. The recording head chip 10 is mounted on top of the manifold 22. The ink supplied from the ink supply tube 21 is led via the ink supply chamber 22*a* to the top of the manifold 22, so that the ink is supplied, via both sides of the recording head chip 10 and spaces a formed on the top of the manifold 22, to the grooves 4 of the recording head chip 10. Then the ink channel 3*a* and the pits 2*a* are filled with the ink by capillarity.

A conductive lead plate 24 having a thin film shape is mounted on the manifold 22 by using a frame 23 so as to cover the recording head chip 10. The conductive lead plate 24 has lead lines, each of which is connected to a corresponding one of the heater elements 6 of the recording head chip 10. That is, a bonding pad connected to each of the lead lines of the conductive lead plate 24 and a bonding pad connected to each corresponding one of the heater elements 6 are connected to each other by wire bonding. The above bonding pads, bonding wires connecting the bonding pads to each other and the like are encapsulated by resin so that they are prevented from contacting the ink. The lead lines of the conductive lead plate 24 are connected to a driver unit (not shown) for driving the recording head chip 10 in accordance with image information.

Figure 4B:
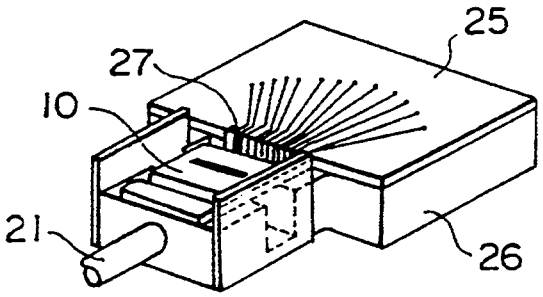
FIG. 4B is a perspective view illustrating an example of the ink jet recording head unit.

FIG. 4B shows another example of an ink jet recording head unit completely assembled. Referring to FIG. 4B, the ink is supplied from the ink supply tube 21 via both sides of the recording head chip 10 and the grooves 4 to the pits 2*a*. The recording head chip 10 and a print circuit board 25 (PCB) are connected by the bonding wires.

Next a description will be given of an outline of the principle of jetting ink drops.

The ink supplied from the ink supply tube 21 to the ink supply chamber 22*a* flows through the grooves 4 and then the ink channel 3*a* of the recording head chip 10 is filled with the ink. In this case, a difference between a water head of an ink reservoir tank connected to the ink supply tube 21 and that of the recording head chip 10 is controlled, so that the ink channel 3*a* of the recording head chip 10 can be easily filled with the ink. The height of the ink on each of the heater elements 6 depends on the depth of a corresponding one of the pits 2*a* and the depth of the ink channel 3*a*. In this case, the height of the ink on each of the heater elements 6 can be finely varied by controlling a meniscus of the ink channel 3*a* in accordance with the principle regarding the difference between the water heads of a U-shaped tube.

In the steady state where the ink channel 3*a* is filled with the ink and the height of the ink on each of the heater elements 6 is controlled, as shown in FIG. 2A, when each of the heater elements 6 is supplied with the electrical power in accordance with the image information, a bubble is generated in the ink on each of the heater elements 6, as shown in FIG. 2B. The ink is then projected from the surface thereof by a propulsion force of the bubble and then an ink drop 5*a* is jetted from the surface of the ink at a portion of the ink channel 3*a* corresponding to each of the pits 2*a* in a substantially vertical direction.

A detailed description will now be given of the principle of jetting ink with reference to FIGS. 5A–5J. An enlarged heater element and surrounding portion thereof are shown in FIGS. 5A–5J. In FIG. 5A–5J, electrodes and the like are omitted for the sake of simplicity.

Figure 5A:
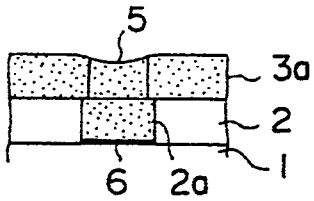
FIGS. 5A–5J is a diagram illustrating a process for jetting an ink drop from the recording head chip.
Figure 5B:
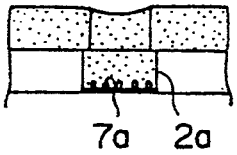
Figure 5C:
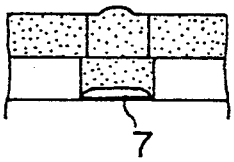
Figure 5D:
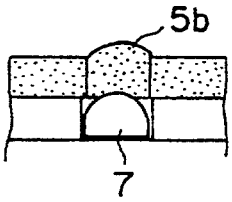
Figure 5E:
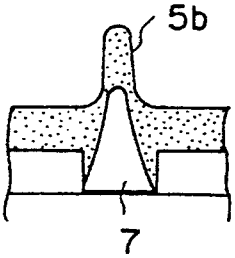
Figure 5F:
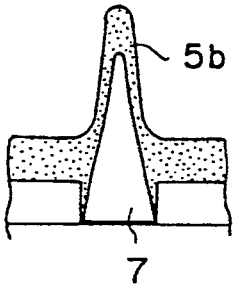
Figure 5G:
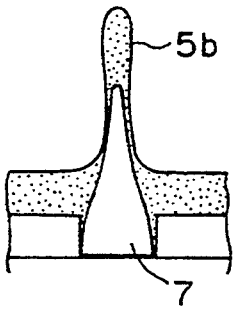
Figure 5H:
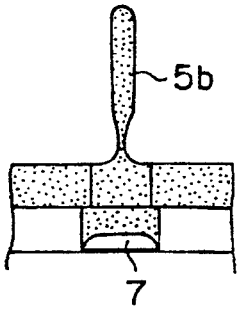
Figure 5I:
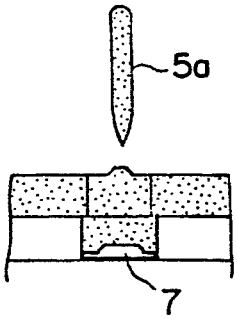

FIG. 5A shows a steady state where the ink channel 3*a* and the pit 2*a* are filled with ink 5 flowing through the ink channel 3*a*. In this steady state, when the electrical power is supplied to the heater element 6, the surface temperature of the heater element 6 is rapidly increased by the heat of the heater element 6. Then the ink is heated until the ink is boiled, so that a state where the ink of the heater element 6 has small bubbles scattered on it is obtained, as shown in FIG. 5B. The ink on the heater element 6 is rapidly heated and vaporized, so that a boiling film, which is a layer of vapor, is generated on the surface of the heater element 6, as shown in FIG. 5C. When a bubble 7 grows up as described above, the surface temperature of the heater element 6 is in a range of 300°–350° C. In the ink existing on the heater element 6, the surface thereof is raised by the propulsion force based on the growth of the bubble 7, as shown in FIG. 5C. FIGS. 5A, 5E and 5F show states where the bubble 7 in the ink on the heater element grows further. In a case shown in FIG. 5D, the surface of the ink is raised further by the growth of the bubble 7. In a case shown in FIG. 5E, the bubble 7 grows further so as to grow higher than the surface of the ink, so that an ink column 5*b* is projected from the surface of the ink. In a case shown in FIG. 5F, the largest bubble 7 is obtained. The time required for obtaining the largest bubble depends on the structure of the ink jet recording head unit 20 (the heater base), conditions in which the pulse signal (the electric power) is supplied to the heater element 6 and the like. A time within a range of 5–30 μsec. is generally required for obtaining the largest bubble. When the largest bubble is obtained, no more electric power is supplied to the heater element 6. Thus, at this time, the surface temperature of the heater elements 6 decreases. A timing at which the largest bubble 7 is obtained is delayed until slightly after a timing at which the electric pulse is supplied to the heater element 6. FIG. 5G shows a state where the bubble 7 is cooled by the ink and the like and thus the bubble 7 starts to contract. In this case, the lead end of the ink column 5*a* is jetted at a speed which is initially obtained and the tail end of the ink column 5*b* is pulled toward the ink existing on the heater element 6. Thus, the ink column 5*b* has a narrow part generated at the tail end portion thereof. When the bubble 7 contracts further, the narrow part of the ink column 5*b* grows further, as shown in FIG. 5H. After this, the ink column 5*b* is separated from the ink existing on the heater element 6 as shown in FIG. 5I, so that an ink drop 5*a* is jetted toward a recording medium (not shown) at a predetermined speed of, for example, within a range of 2–20 m/sec. The speed at which the ink drop 5*a* is jetted depends on the structure of the ink jet recording head unit 20 (the heater base), characteristics of the ink, conditions in which the electric pulse (the electric power) is supplied to the heater element and the like. In a case where the ink drop is jetted at a low speed (e.g. 2–3 m/sec.), the ink drop 5*a* is short. The higher the speed at which the ink drop 5*a* is jetted, the longer the ink drop 5*a* (e.g. 6–8 m/sec.). Then, in a case where the ink drop 5*a* is jetted at an extremely high speed (e.g. 15–20 m/sec.), a slender ink drop and many small ink drops are simultaneously jetted. It is preferable that the ink drop be jetted at a speed equal to or greater than 5 m/sec.

Figure 5J:
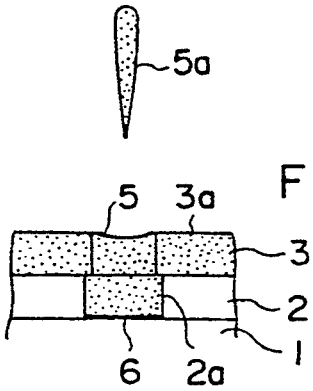

After the ink drop is jetted from the recording head chip, the ink existing on the heater element 6 returns to the steady state shown in FIG. 5J. That is, the pit 2*a* is filled with the ink and the bubble completely disappears.

A description will now be given of a difference between the process for jetting ink according to the present invention and the process for jetting ink according to the conventional recording head.

In the conventional recording head disclosed in Japanese Patent Laid Open Publication Nos. 51-132036 and 61-189950, when the surface of the ink is exploded, the ink drop generated by the explosion of the surface of the ink is jetted from the recording head. In this conventional recording head, an ink mist is easily generated by the explosion of the surface of the ink. Thus, the quality of an image which is formed of the ink dots is deteriorated by the ink mist. In the other conventional recording head disclosed in Japanese Laid Open Publication No. 1-101157, the ink (the recording agent) is quickly boiled so that the mist shaped ink is jetted from the recording head. In the other conventional recording head also, the quality of the image which is formed by the ink is deteriorated by the ink mist.

On the other hand, in the process for jetting the ink drop according to the present invention, as the ink drop is generated in accordance with a process having the steps of generating the bubble in the ink, making the bubble grow, contracting the bubble and making the bubble disappear, generation of the ink mist caused by the explosion of the surface of the ink can be prevented. Thus determination of the quality of the image formed of the ink dots is prevented. The ink dots, which instead of being mist-shaped lumps of ink, are adhered to the surface of the recording medium so that the image is formed on the recording medium. Thus, a clear image on the recording medium can be obtained.

Further in the ink jet recording head according to the present invention, as each of the heater elements is provided in a corresponding one of the pits, the direction in which the bubble is generated in the ink is fixed and the propulsion force caused by the bubble is efficiently transmitted to the ink. Thus, the ink drop is definitely generated and is accurately jetted in the vertical direction. In addition, as the ink is supplied via the ink channel to each of the pits, the depth of the ink on each of the heater elements depends on the depth of the channel and the depth of each of the pits. Thus, the depth of the ink on the heater element, which affects the jetting of the ink drop, can be accurately controlled by filling the channel and each of the pits with the ink.

A detailed description will now be given of the structure of the heater base and a process for forming the same.

Figure 6:
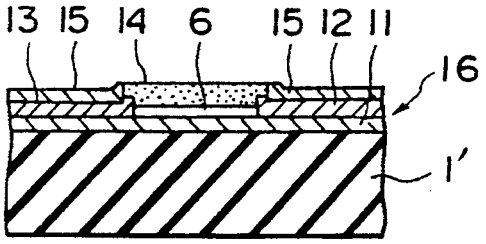
FIG. 6 is a cross sectional view illustrating an example of the structure of the recording head chip.

The heater base 1 is one of the important parts of the recording head chip 10. Referring to FIG. 6, the heater base 1 has a substrate 1', a heat reserve layer 11, a heating layer 6 (the heater element), a control electrode 12, an earth electrode 13, a first protection layer 14 and a second protection layer 15. The heat reserve layer 11, the heating layer 6, the control and earth electrodes 12 and 13, and first and second protection layers 14 and 15 form a heater portion 16 of the heater base 1. The substrate 1' is made, for example, of glass, alumina ($Al_2O_3$), silicon or the like. The heat reserve layer 11 is made, for example, of $SiO_2$. In a case where the substrate 1' is made of glass or alumina, the heat reserve layer 11 is formed on the surface of the substrate 1' by the sputtering process. In a case where the substrate 1' is made of silicon, the heat reserve layer 11 is formed on the surface of the substrate 1' by the heat oxidation process. It is preferable that the heat reserve layer 11 have a thickness in a range of 1–5 μm.

The heating layer 6 can be made of a mixture of tantalum-$SiO_2$, tantalum nitride, nickel-chromium alloy, a silver-palladium alloy silicon semiconductor, or a boride of metal such as hafnium, lanthanum, zirconium, titanium, tantalum, tungsten, molybdenum, niobium, chromium or vanadium. The metal boride is suited for use as a material forming the heating layer 6. Of the above materials, hafnium boride is most suited for use as the material forming the heating layer 6, and then zirconium boride, lanthanum boride, tantalum boride, vanadium boride and niobium boride are, in this order, suited for use as the material forming the heating layer 6. The heating layer 6 is formed on the surface of the heat reserve layer 11 by an electron-beam process, an evaporation process, a sputtering process or the like. The thickness of the heating layer 6 is determined in accordance with the area thereof, the material forming the heating layer 6, the shape and the size thereof, and the power which is actually consumed by the heating layer 6 so that the amount of heat generated from the heating layer 6 becomes a predetermined value. The thickness of the heating layer 6 is normally in a range of 0.01–5 μm, and preferably in a range of 0.01–1 μm.

The control electrode 12 and the earth electrode 13 are made of a material usually used for an electrode. That is, both the electrodes 12 and 13 can be made of Al, Ag, Au, Pt, Cu or the like. The control electrode 12 and the earth electrode 13 are formed on the heat reserve layer 11 so as to be connected to ends of the heating layer 6 by a process such as the evaporation process.

The first protection layer 14 is formed on the heating layer 6 to protect the heating layer 6 under a condition in which heat generated from the heating layer 6 is efficiently prevented from being transmitted to the ink existing on the first protection layer 14. The first protection layer 14 can be made of silicon dioxide ($SiO_2$), silicon nitride, magnesium oxide, aluminium oxide, tantalum oxide, zirconium oxide, or the like. The first protection layer 14 is formed on the heating layer 6 by a process such as the electron-beam process, the evaporation process or the sputtering process. The thickness of the first protection layer 14 is normally in a range of 0.01–10 μm, preferably in a range of 0.1–5 μm, and more preferably in a range of 0.1–3 μm. The first protection layer 14 has one or a plurality of layers. To protect the heater portion 16 from a cavitation which is generated when the bubble is formed and then disappears in the ink, a metal layer made, for example, Ta is preferably formed on the first protection layer 14. The thickness of the metal layer (Ta) is in a range of 0.05–1 μm.

The second protection layer 15 is made of a material, such as polyimideisoindroquinazolinedion (PIQ, manufactured by HITACHI KASEI CO., LTD.), polyimide resin (PYRALIN, manufactured by DUPONT CO., LTD.), cyclic polybutadiene (JSR-CBR, manufactured by NIPPON GOSEI GOMU CO., LTD.), photoneece (manufactured by TORAY CO., LTD.), or other photosensitive polyimide resins.

A description will now be given of modifications of the recording head chip.

A pulse laser beam or an electrical discharge can be used for heating the ink instead of the heating layer 6 which supplies the Joule' heat to the ink.

In a system disclosed in Japanese Patent Laid Open Publication No. 1-184184 (FIGS. 8 and 9A–9E), the ink is heated by use of a laser beam. In this system, a laser unit is modulated in accordance with the image information so that a pulse modulated laser beam emitted from the laser unit is obtained. The pulse modulated laser beam emitted from the laser unit is focused on an outer wall of the recording head by an optical system so that the ink in contact with the inside of the outer wall is heated. Thus, a bubble is generated in the ink in contact with the outer wall. In a case where the outer wall is made of a material through which the laser beam can pass, the laser beam is focused via the outer wall at a predetermined position in the ink inside of the outer wall so that the ink is directly heated by the pulse modulated laser beam.

Figure 10:
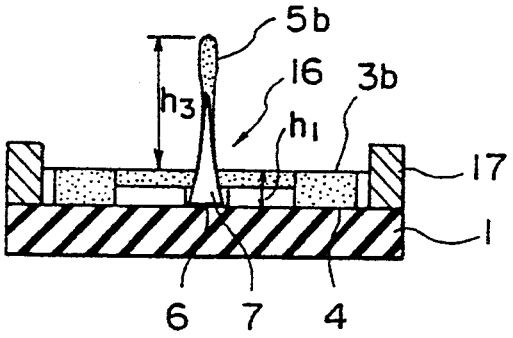
FIG. 10 is a diagram illustrating a relationship between the depth of the ink layer on the heater element and the height of the ink column projecting from the surface of the ink layer.

A system in which the ink is heated by use of an electric discharge is also disclosed in Japanese Patent Laid Open Publication No. 1-184184 (FIG. 10). In this system, a pair of electrodes are formed on the inside of the wall so that the electric discharge is generated between the electrodes in the ink when a high voltage is supplied to the pair of electrodes. The bubble quickly grows in the ink due to the heat generated by the electric discharge. The electrodes can have various shapes as disclosed in the Japanese Patent Laid Open Publication No. 1-184184 (FIGS. 11 through 18).

Components of the ink used in the recording head are determined so that the ink has a predetermined properties required for printing. That is, the ink is prepared so that the following properties are obtained.

The ink is chemically and physically stable. The ink has superior responsiveness. The ink does not set in a flow path. The ink can flow at a speed corresponding to a speed at which the ink drop is jetted. The ink can be immediately fixed on the recording sheet. A recorded image having sufficient density can be obtained. The ink has a long life.

For example, the ink having the properties disclosed in Japanese Patent Laid Open Publication No. 1-184184 is suited for use in the ink jet recording head according to the present invention.

EXAMPLE 1

In Example 1, a dot image was recorded on a recording sheet under the following conditions.

| | |
|---|---|
| SIZE OF HEATING LAYER 6 | 80 μm × 80 μm |
| RATE OF ARRANGEMENT OF HEATER ELEMENTS 6 | 200d dpi |
| THE NUMBER OF HEATER ELEMENTS 6 | 128 |
| RESISTANCE OF HEATER ELEMENT6 | 121 ohm |
| THE DEPTH OF PIT 2a | 30 μm |
| (formed by photolithography of BMRS1000) | |
| INK SUPPLY CHANNEL 3a | WIDTH 50 μm<br>DEPTH 30 μm |
| (formed by a photosensitive glass) | |
| DRIVING VOLTAGE | 30 V |
| PULSE WIDTH | 6 usec. |
| CONTINUOUS DRIVING FREQUENCY | 3 kHz (SOLID PRINTING) |
| INK | INK USED IN BJ130 (CANON CO., LTD.) |

"RATE OF ARRANGEMENT OF HEATER ELEMENTS" is defined as the number of heater elements arranged in a predetermined area.

A dot image was formed on the matted coat sheet NM (manufactured by MITSUBISHI SEISHI CO.,LTD.), so that a fine dot image was obtained. The mean value of the diameters of the ink dots adhered to the sheet was 115 μm. In continuous driving at 3 kHz, the speed of the jetted ink drops was 8 m/sec. That is, the dot image could be formed on the sheet at a high speed.

EXAMPLE 2

In Example 2, a dot image was recorded on a recording sheet under the following conditions.

| | |
|---|---|
| SIZE OF HEATING LAYER 6 | 40 μm × 40 μm |
| RATE OF ARRANGEMENT OF HEATER ELEMENTS 6 | 400d dpi |
| THE NUMBER OF HEATER ELEMENTS 6 | 128 |
| RESISTANCE OF HEATER ELEMENT6 | 122 ohm |
| THE DEPTH OF PIT 2a | 25 μm |
| (formed by photolithography of BMRS1000) | |
| INK SUPPLY CHANNEL 3a | WIDTH 30 μm<br>DEPTH 18 μm |
| (formed by photolithography of BMRS1000) | |
| DRIVING VOLTAGE | 23 V |
| PULSE WIDTH | 7.2 usec. |
| CONTINUOUS DRIVING FREQUENCY | 4.5 kHz (SOLID PRINTING) |
| INK | INK USED IN BJ130 (CANON CO., LTD.) |

A dot image was formed on the matted coat sheet NM (manufactured by MITSUBISHI SEISHI CO.,LTD.), so that a fine dot image was obtained. The mean value of the diameters of the ink dots adhered to the sheet was 86 μm. In continuous driving at 4.5 kHz, the speed of the jetted ink drops was 9.3 m/sec. That is, the dot image could be formed on the sheet at a high speed.

EXAMPLE 3

The same heater base as that used in Example 1 was used in this example. The pit was formed by photolithography of BMRS1000. No ink supply channel was formed on the recording head chip. The heater base having the pits was directly mounted in the ink jet recording head unit. The ink was supplied to the surface of the heater base so that an ink layer was formed on the heater base. In the above state, a driving signal was supplied to each of the heater elements. In this case, the depth of the ink layer was 30 μm. As the depth of each of the pits was 30 μm, the depth of the ink on each of the heater elements was 60 μm. The ink jet recording head was driven under the same conditions as those described in Example 1. As a result, the mean value of the diameters of ink dots adhered to the matted coat sheet NM was 110 μm. In continuous driving at 3 kHz, the speed of the jetted ink drops was 7.7 m/sec.

EXAMPLE 4

In this example, an optimum relationship between a depth of the ink layer existing on each of the heater elements and the height of the bubble was found.

Figure 7A:
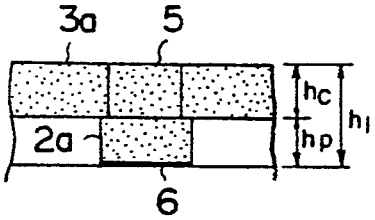
FIG. 7A is a diagram illustrating the depth of the ink in a heater portion in a steady state.
Figure 7B:
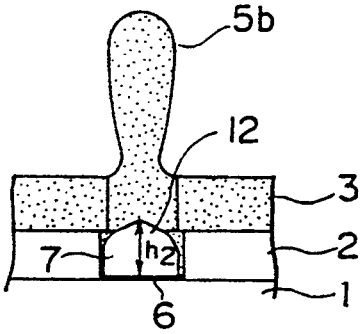
FIG. 7B is a diagram illustrating the depth of the ink in the heater portion in a state where the largest bubble is obtained.

FIG. 7A shows an essential part of the ink jet recording head in a steady state. FIG. 7B shows an essential part of the ink jet recording head in a driving state in which the ink jet recording head is driven. In the ink jet recording head, the ink drops were jetted under various depth $h_1$ conditions of the ink layer. The depth $h_1$ is approximately defined as the sum of the depth $h_p$ of the pit 2a and the depth $h_c$ of the ink supply channel 3a (a slight concavity based on the meniscus of the ink supply channel 3a is ignored).

Each of the heater elements was driven under the same conditions as those described above in a state where the heater base was put under the ink (the depth of the ink was equal to or greater than 1 mm). In this case, the ink dot was not generated, but the height $h_2$ of the largest bubble was approximately the same value as that obtained in the case shown in FIG. 5A–5J.

The experiment for jetting the ink drops was carried out, by using the heater base used in Example 1, under various depth conditions of the pit and the ink supply channel. The slight concavity (approximately 3 μm.) based on the meniscus of the ink supply channel was ignored. The dot image was formed under the same driving conditions described in Example 1.

| | |
|---|---|
| SIZE OF HEATING LAYER 6 | 80 μm × 80 μm |
| RATE OF ARRANGEMENT OF HEATER ELEMENTS 6 | 200d dpi |
| THE NUMBER OF HEATER ELEMENTS 6 | 128 |
| RESISTANCE OF HEATER ELEMENT6 | 121 ohm |
| DRIVING VOLTAGE | 30 V |
| PULSE WIDTH | 6 usec. |
| CONTINUOUS DRIVING FREQUENCY | 3 kHz (SOLID PRINTING) |
| INK | INK USED IN BJ130 (CANON CO., LTD.) |

The depths of the pit and the ink supply channel were varied so that the depth $h_1$ of the ink varied in a range of 10–75 μm, as indicated in Table-1. The ink supply channel was formed by photolithography of BMRS1000 except in the cases indicated by * in Table-1. The pit was formed by photolithography of BMRS1000.

When the depth $h_1$ of the ink layer was 32, 40, 48, 60 or 75 μm, a fine image formed of dots each having an approximately round shape was obtained on the recording sheet. On the other hand, when the depth $h_1$ of the ink layer was 10, 20 or 26 μm, an image having small dots which were dispersed in all directions was formed on the recording sheet so that the quality of the image deteriorated.

In Example 4, a vehicle which is a transparent liquid obtained by removing dye component from the ink was substituted for the ink. The vehicle has substantially the same properties as the ink. Then, the shape of the jetted vehicle and the state of the bubble formed in the vehicle were observed by use of a stroboscope driven in synchronism with the driving signal for the ink jet recording head. As a result, the height $h_2$ of the largest bubble which was generated under a condition in which the heater base was set under the vehicle (the depth of the vehicle was equal to or greater than 1 mm) was 40 μm. When the depth $h_1$ of the vehicle layer was 10, 20 or 26 μm, the bubble exploded so that the vehicle was dispersed to form a mist. The results in Example 5 are indicated in the following Table-1.

TABLE 1

| $h_1$ (μm) | hp (μm) | hc (μm) | $h_1/h_2$ | SHAPE OF JETTED INK | STABILITY |
|---|---|---|---|---|---|
| 10 | 5 | 5 | 0.25 | mist | x |
| 20 | 10 | 10 | 0.5 | mist | x |
| 26 | 16 | 10 | 0.65 | mist | x |
| 32 | 17 | 15 | 0.8 | column | ∘ |
| 40 | 25 | 15 | 1 | column | ⊚ |
| 48 | 25 | 23 | 1.2 | column | ⊚ |
| 60 | 30 | 30* | 1.5 | column | ⊚ |
| 75 | 35 | 40* | 1.875 | drop | ∘ |

x: very insecurity
∘: stabilized
⊚: very stabilized

As indicated in Table-1, when $h_1/h_2 \geqq 0.8$, the jetted ink had either a column shape or a drop shape. On the other hand, when $h_1/h_2 < 0.8$, the ink was dispersed to form a mist.

Thus, the depth $h_1$ of the ink layer is preferably set so as to satisfy $h_1 \geqq 0.8h_2$, where $h_2$ is the height of the largest bubble generated in a state where the heater base is set under the ink. It is further preferable that the depth $h_1$ be set so as to satisfy $h_1 \geqq h_2$.

When the jetted ink had either the column shape or the drop shape, the growth of the bubble, the contraction of the bubble and the disappearance of the bubble was sequentially carried out in the ink, as shown in FIG. 5A–5J. In this case, the surface of the ink was not exploded, so that dispersal of the ink was prevented from forming a mist.

EXAMPLE 5

In this example, an optimum condition of a cycle of the driving signal for forming an image at a high speed was found.

Figure 8:
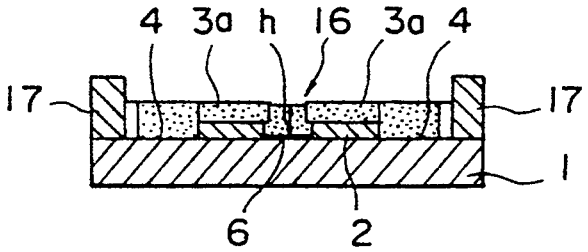
FIG. 8 is a cross sectional view of another example of the structure of the recording head chip.

FIGS. 8, 9A–9E are cross sectional views taken along the line 11—11 shown in FIG. 1. Referring to FIG. 8, side walls 17 are formed on the heater base 1. The ink was jetted under the following conditions.

There were three kinds of driving pulse signals supplied to the heater base. The first pulse signal had a first width so that a half width of the energy pulse generated by the heater element was 6 μsec., the second pulse signal had a second width so that a half width of the energy pulse generated by the heater element was 10 μsec., and the third pulse signal had a third width so that a half width of the energy pulse generated by the heater element was 20 μsec. A cycle of each driving pulse was set at various values; 20 μsec., 30 μsec., 40 μsec., 60 μsec., 100 μsec., 500 μsec., and 1 msec.. That is, a frequency of each driving pulse signal was set at various values; 50 kz, 33.3 kHz, 25 kHz, 16.7 kHz, 10 kHz, 2kHz and 1 kHz. SIZE OF HEATING LAYER 6 : 80 μm×80 μm RESISTANCE OF HEATER ELEMENT6 : 200 ohm INK : INK USED IN BJ130 (CANON CO.,LTD.)

When the image was printed on the recording sheet, the results indicated in Table-2 were obtained.

TABLE 2

| HALF WIDTH | CYCLE (usec.) | VOLTAGE (v) | QUALITY |
|---|---|---|---|
| 6 usec. | 20 | 10 | x (mist) |
| | 30 | 11 | x (mist) |
| | 40 | 15 | ○ |
| | 60 | 20 | ◎ |
| | 100 | 25 | ◎ |
| | 500 | 30 | ◎ |
| | 1000 | 30 | ◎ |
| 10 usec. | 20 | 8 | x |
| (not in synchronism with the driving pulse; mist) | | | |
| | 30 | 10 | x (mist) |
| | 40 | 11 | ○ |
| | 60 | 12 | ◎ |
| | 100 | 14 | ◎ |
| | 500 | 23 | ◎ |
| | 1000 | 25 | ◎ |
| 20 usec. | 20 | 6 | x |
| (not in synchronism with the driving pulse; mist) | | | |
| | 30 | 6 | x |
| (not in synchronism with the driving pulse; mist) | | | |
| | 40 | 8 | x (mist) |
| | 60 | 9 | ○ |
| | 100 | 10 | ◎ |
| | 500 | 10 | ◎ |
| | 1000 | 19 | ◎ |

x: bad
○: fine
◎: very fine

EXAMPLE 6

In Example 6, the image was formed by use of the recording head shown in FIG. 8 under the same conditions as described in Example 2. SIZE OF HEATING LAYER 6 : 40 μm×40 μm RESISTANCE OF HEATER ELEMENT6 : 122 ohm INK : INK USED IN BJ130 (CANON CO.,LTD.) RECORDING SHEET : MATTED COAT SHEET NM The three kinds of driving pulse signals were used for driving the recording head: the first pulse signal having a first width so that a half width of the energy generated by the heater element was 3 usec., the second pulse signal having a second width so that a half width of the energy generated by the heater element was 8 μsec., and the third pulse signal having a third width so that a half width of the energy generated by the heater element was set at various values; 20 usec. A cycle of each driving pulse signal was varied into 10 μsec., 30 μsec., 40 μsec., 50 μsec., 100 μsec., 500 μsec., and 1 msec. That is, a frequency of each driving pulse signal was set at various values; 100 kHz, 33.3 kHz, 20 kHz, 10 kHz, 2 kHz, and 1 kHz.

When the image was printed on the recording sheet, the results indicated in Table-3 were obtained.

TABLE 3

| HALF WIDTH | CYCLE (usec.) | VOLTAGE (v) | QUALITY |
|---|---|---|---|
| 3 usec. | 10 | 6 | x (mist) |
| (not in synchronism with the driving pulse; mist) | | | |
| | 30 | 12 | x (mist) |
| | 40 | 14 | ○ |
| | 50 | 20 | ○ |
| | 100 | 30 | ◎ |
| | 500 | 35 | ◎ |
| | 1000 | 35 | ◎ |
| 8 usec. | 10 | 5 | x |
| (not in synchronism with the driving pulse; mist) | | | |
| | 30 | 8 | x (mist) |
| | 40 | 10 | ○ |
| | 50 | 12 | ○ |
| | 100 | 16 | ◎ |
| | 500 | 23 | ◎ |
| | 1000 | 23 | ◎ |
| 20 usec. | 10 | 3 | x |
| (not in synchronism with the driving pulse; mist) | | | |
| | 30 | 4 | x |
| (not in synchronism with the driving pulse; mist) | | | |
| | 40 | 6 | x (mist) |
| | 50 | 8 | ○ |
| | 100 | 10 | ◎ |
| | 500 | 15 | ◎ |
| | 1000 | 15 | ◎ |

x: bad
○: fine
◎: very fine

According to the results indicated in Tables-1 and 2, when the cycle T of the driving pulse signal is equal to or greater than (t+30) μsec., preferably more than (t+50) μsec., where t is a half width of the energy pulse generated by the heater element, the image can be stably formed on the recording sheet.

Figure 9A:
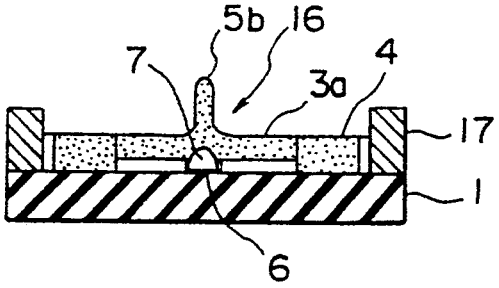
FIG. 9A–9E is a diagram illustrating a process for jetting an ink drop from the recording head chip shown in FIG. 8.
Figure 9B:
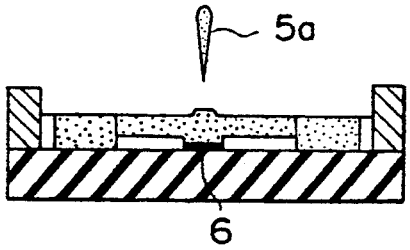
Figure 9C:
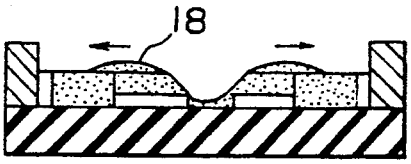
Figure 9D:
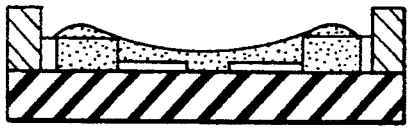
Figure 9E:
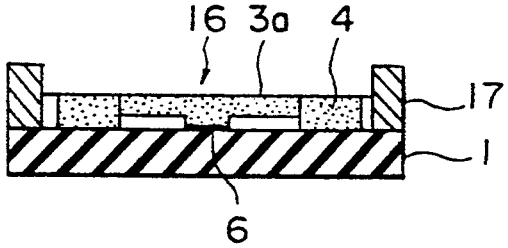

In a state where the vehicle which was transparent and had approximately the same properties as the ink was substituted for the ink used for BJ 130 (CANON CO.,LTD), the jetted vehicle was observed by use of a stroboscope. The states where the vehicle is jetted are shown in FIGS. 9A–9E. FIG. 9A shows a state where the largest bubble 7 obtained is such that the ink column **5*b* projects from the surface of the liquid. FIG. 9B shows a state where the bubble has been contracted. FIG. 9C shows a state where the bubble 7 has been completely disappeared. When the bubble has completely disappeared as shown in FIG. 9C, a wave 18 is generated on the surface of the liquid in the ink supply channel around the heater portion 16, so that the depth h of the liquid at the heater portion 16 becomes less than that of the liquid in the steady state. The wave 18 is expanded in directions shown by arrows in FIG. 9C. FIG. 9D shows a state where the wave 18 has further expanded. After this the surface of the liquid at the heater portion 16 is raised, so that the surface of the liquid (the ink) returns to the steady state, as shown in FIG. 9E**.

The optimum driving conditions were obtained based on the above movement of the surface of the liquid. That is, the following matters were found out.

The depth of the liquid at the heater portion 16 could be decreased to a value in a range of 20–80% of the depth h of the liquid in the steady state. The bubble 7 completely disappeared 10 μsec. after the driving pulse was turned off. In a state where the cycle of the driving pulse was equal to or greater than (t+30)μsec., the wave 18 was expanded far away from the heater portion 16, so that the surface of the liquid returned to the steady state ($h_1 \geqq 0.8$) existing before the heater portion 16 was activated. When the processes by which the bubble is generated, grow, contracted, and disappear were carried out, the ink was stably jetted in accordance with the driving pulse signal, as shown in FIGS. 5A–5J.

On the other hand, in a case where the cycle of the driving pulse was less than (t+30) μsec., the heater portion 16 was activated before the surface of the liquid returned to the steady state. In this case, as the driving pulse signal was turned on in a state where the depth of the liquid at the heater portion 16 was less than the depth of the liquid in the steady state, the ink was quickly boiled and dispersed to form a mist.

The conventional recording head does not have the above problems where the quality of the image formed on the recording sheet is deteriorated due to the wave which is generated on the surface of the ink in the recording head when the recording head is driven. Example 6 was carried out to obtain the optimum the driving pulse signal condition.

EXAMPLE 7

In Example 7, an optimum condition regarding a relationship between the depth of the ink layer at the heater portion 16 and the length of the ink column **5*b*** was found.

FIG. 10 shows a state where the ink column **5*b* projects from the surface of the ink at the heater portion 16 in the recording head. In FIG. 10, $h_1$ indicates the depth of the ink layer at the heater portion 16 (see FIG. 7(*a*)), and $h_3$ indicates the length of the ink column which projects from the surface of the ink when the heater portion 16** is driven in accordance with predetermined conditions.

The jetting ink experiment was performed while the depth $h_1$ of the ink layer at the heater portion 16 was varied by varying the depth $h_p$ of the pit and the depth $h_c$ of the ink channel. In Example 7, the same conditions as those described in Example 4 were set. The vehicle was substituted for the ink used for BJ130 (CANNON). The results which were obtained in Example 7 are indicated in Table-4.

TABLE 4

| $h_1$ (μm) | $h_3$ (μm) | SHAPE OF JETTED INK | JETTING SPEED (m/s) | STABILITY |
|---|---|---|---|---|
| 32 | 680 | column | 16 | ◎ |
| 40 | 660 | column | 12.5 | ◎ |
| 48 | 620 | column | 11.3 | ◎ |
| 60 | 440 | column | 10.7 | ◎ |
| 75 | 380 | column | 8 | ∘ |
| 100 | 170 | drop | 2 | Δ |
| 130 | 150 | drop | 1.5 | Δ |
| 200 | 100 | not jetted | — | — |

Δ: slightly insecure
∘: stabilized
◎: very stabilized

As shown by the results indicated in Table-4, the ink can be stably jetted in a case where the depth $h_1$ of the ink layer at the heater portion 16 is less than the length $h_3$ of the ink column projecting from the surface of the ink layer. In a case where $h_3 > 5h_1$, the ink can be stably jetted at a high speed.

EXAMPLE 8

In Example 8, the jetting ink experiment was performed by use of a recording head having no ink channel. In this case, only the pits are formed on the heater base, and the ink is supplied to the surface of the heater base by using a difference between the water head of an ink reservoir tank and that of the heater base. The results obtained in Example 8 is indicated in Table-5.

TABLE 5

| $h_1$ (μm) | $h_3$ (μm) | SHAPE OF JETTED INK | JETTING SPEED (m/s) | STABILITY |
|---|---|---|---|---|
| 30 | 600 | column | 14 | ◎ |
| 50 | 550 | column | 11.9 | ◎ |
| 70 | 360 | column | 6.8 | ∘ |
| 100 | 120 | drop | 1.3 | Δ |
| 130 | 50 | not jetted | — | — |

Δ: slightly insecure
∘: stabilized
◎: very stabilized

In Example 8, approximately the same results as those in Example 7 were obtained. That is, the ink can be stably jetted in a case where the depth $h_1$ of the ink layer at the heater portion 16 is less than the length $h_3$ of the ink column projecting from the surface of the ink layer. In a case where $h_3 > 5h_1$, the ink can be stably jetted at a high speed.

EXAMPLE 9

Figure 11:
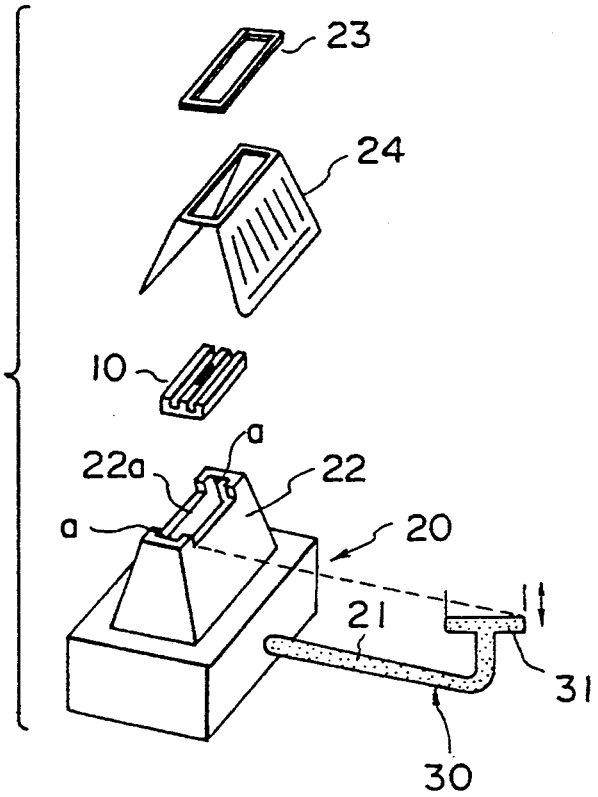
FIG. 11 is an exploded perspective view illustrating another example of the ink jet recording head unit.

A description will now given of Example 9, with reference to FIG. 11.

Referring to FIG. 11, which shows a structure of the ink jet recording head, the ink jet recording head unit 20 has the manifold 22, the recording head chip 10, the conductive lead plate 24 and the frame 23 in the same manner as shown in FIG. 4A. A U-shaped tube 30 connects an ink supplier 31 to the ink jet recording head unit 20 so that ink in the ink supplier 31 is communicated with the ink in the ink recording head unit 20. The U-shaped tube 30 functions as means for adjusting the depth of the ink on each of the heater elements of the ink jet recording head unit 20. That is, a level of the surface of the ink in the ink supplier 31 and a level of the surface of the ink in the recording head are always equal to each other as indicated by a dashed line in FIG. 11. Thus, the depth of the ink at the heater portion 16 can be controlled by moving the ink supplier 31 upward and downward. In this ink jet recording head unit 20, the ink supplier 31 is moved upward and/or downward so that the depth $h_1$ of the ink layer at the heater portion 16 becomes equal to or greater than $0.8h_2$, where $h_2$ is the height of the largest bubble generated in a state where the heater base is set under the ink (e.g. 1 mm), as described Example 4. In addition, the ink supplier 31 is moved so that the depth $h_1$ of the ink layer at the heater portion 16 also becomes less than the length $h_3$ of the ink column **5*b* projecting from the surface of the ink, as Examples 7 and 8. The ink supplier 31** is moved in accordance with the amount of the ink consumed to form an image on the recording sheet.

Figure 12:
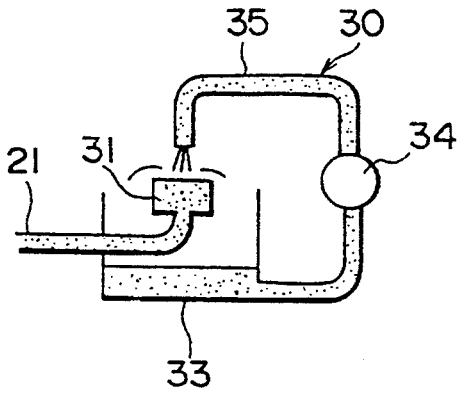
FIG. 12 is a diagram illustrating the principle of a mechanism for maintaining the depth of the ink layer in the recording head chip at a constant value.

FIG. 12 shows a modification of the ink jet recording head unit shown in FIG. 11. Even if the large amount of ink is consumed to form an image on the recording sheet, the depth $h_1$ of the ink layer at the heater portion 16 can be maintained at a predetermined value ($h_1/h_2 \geqq 0.8$ and/or $h_1 < h_3$) in the ink jet recording head unit shown in FIG. 12. That is, an ink reservoir tank 33, a pump 34 and a supply tube 35 are respectively arranged in a path through which the ink is circulated. A level of the surface of ink overflowing the ink supplier 31 is always equal to a level of the surface of the ink in the recording head. The ink which overflows the ink supplier 31 is accumulated in the ink reservoir tank 33. The ink in the ink reservoir tank 33 is pumped into the ink supplier 31 by the pump 34 via the supply tube 35. The ink always overflows the ink supplier 31. The level of the surface of the ink layer at the heater portion is always limited to a level corresponding to a position at which the ink overflows the ink reservoir tank 31. Thus, even if a large amount of the ink is consumed to form an image on the recording sheet, the level of the surface of the ink layer at the heater portion 16 can always be at a constant value.

In the ink jet recording head unit 20 shown in FIGS. 11 and 12, the depth $h_1$ of the ink layer at the heater portion 16 can be easily maintained at a value which satisfies the conditions of $h_1/h_2 \geqq 0.8$ and/or $h_1 < h_3$.

EXAMPLE 10

Figure 13A:
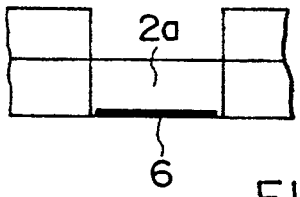
FIGS. 13A–13C is a diagram illustrating relationships between each of pits and a corresponding one of heater elements.
Figure 13B:
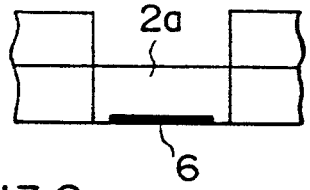

In Example 10, an area of each pit will now be examined. FIG. 13A shows a structure in which an area of each pit 2a is small so that edges of each heater element 6 are close to inner walls of each pit 2a. FIG. 13B shows a structure in which an area of each pit 2a is large so that the edges of each heater element 6 are slightly at a distance from the inner walls of each pit 2a. The degree of efficiency with which the bubble generated in the ink layer affects jetting of the ink in the structure shown in FIG. 13A differs from the degree of efficiency obtained by the structure shown in FIG. 13B. An allowable degree of efficiency in an actual use of the recording head was experimentally examined.

Figure 13C:
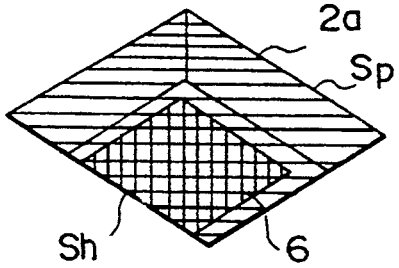

The experiment for jetting the ink was carried out while the size of the pit was set various values. The heater element 6 provided in the pit 2a had a constant area 80 μm×80 μm ($S_h$=6400 μm$^2$). A pit area $S_p$ was defined as an area having horizontal lines shown in FIG. 13C. A heater area $S_h$ was defined as an area having vertical lines shown in FIG. 13C. In FIG. 13C, the ink supply channel is omitted for the sake of simplicity.

The pit 2a and the ink supply channel were formed by photolithography of the liquid photoresist BMRS1000. Both the pit 2a and the ink supply channel had 30 μm depth. The vehicle was substituted for the ink. A rate of the arrangement of heater elements was normally 200 dpi (dot per inch). When the pit area $S_p$ was large, the rate of the arrangement of heater elements was changed to 100 dpi. The results obtained in Example 10 are indicated in Table-6.

TABLE 6

| A SIDE OF PIT AREA (μm$^2$) | PIT AREA S (μm$^2$) | SHAPE OF JETTED INK | JETTING SPEED (m/s) | STABILITY |
|---|---|---|---|---|
| 80 | 6400 | column | 11 | ◎ |
| 85 | 7225 | column | 10.4 | ◎ |
| 95 | 9025 | column | 7.8 | ◎ |
| 105 | 11025 | column | 7.3 | ◎ |

TABLE 6-continued

| A SIDE OF PIT AREA (μm$^2$) | PIT AREA S (μm$^2$) | SHAPE OF JETTED INK | JETTING SPEED (m/s) | STABILITY |
|---|---|---|---|---|
| 115 | 13225 | column | 6.9 | ◎ |
| 125 | 15625 | column | 6.1 | ○ |
| 135 | 18225 | drop | 1 | Δ |
| 150 | 22500 | not jetted | — | — |

Δ: slightly insecure
○: stabilized
◎: very stabilized

According to the results indicated in Table-6, it is known that the ink can be stably jetted when $S_h \leqq S_p < 2.5S_h$ is satisfied.

EXAMPLE 11

FIGS. 14A–14H show an example of a process for forming a recording head chip. FIGS. 14A–14D shows various cross sections, taken along the line 11—11 shown in FIG. 1, of the recording head chip. FIGS. 14E–14H shows various cross sections, taken along the line 12—12 shown in FIG. 1, thereof. In this example, the ink supplying plate 3, which is formed on the photoresist film 2 having the pits is also made of a photoresist material.

The heater base 1 is made prior a FIG. 14A. The heater layer 6 made of metal boride is formed on the surface of a substrate made of glass, alumina, silicon or the like, and then a first protection layer made of tantalum oxide, zirconium oxide or the like and a second protection layer made of metal such as Ta are stacked on the surface of the substrate, so that the heater base 1 is formed.

In FIG. 14A, the photoresist film 2 is coated on the surface of the heater base 1, and a photomask 8 is stacked on the photoresist film 2 at a position corresponding to the heater layer 6 of the heater base 1. Then the photoresist film 2 is exposed. BMRS100 manufactured by TOKYO OHKA CO.,LTD. is used as the photoresist film 2. The photoresist film 2 having a 30 μm thickness is formed on the surface of the heater base 1 in accordance with a spin coating process at a rotation of 500 rpm at 20° C. for 30 sec.

In FIG. 14B, after the stacked structure obtained in FIG. 14A is developed, Au is deposited on the surface of the stacked structure by 500 Å by sputtering so that a metal layer 9 is formed on the stacked structure.

In FIG. 14C, 30 μm of a photoresist (the ink supply plate 3) is coated on the metal layer 9, and the photomask 8 is put on the photoresist 3 so that the photomask covers areas corresponding to the pits, grooves and ink supply channel. Then the photoresist 3 is exposed. The photoresist 3 is made of the same material as the photoresist film 2 and is coated on the metal layer 9 by the spin coating process.

In FIG. 14D, the photoresist 3 is developed.

In accordance with the above process having FIGS. 14A through 14D, the recording head chip having the photoresist layer on which the ink supply channel is formed can be formed.

The above process for forming the recording head chip having two laminated photoresist layers can be used for forming other structures, such as a fluid logic element, a nozzle plate of an ink jet printer, and a die for various three dimensional structures which can be formed by precipitation of Ni or the like performed by an electro-forming process.

FIGS. 15A and 15B show a cross section of the recording head chip formed in a state where there is no metal layer between the photoresist layers 2 and 3. FIG. 15A is a cross sectional view taken along the line 11—11 shown in FIG. 1, and FIG. 15B is a cross sectional view taken along the line 12—12 shown in FIG. 1. In this case, when the photoresist layer 3 is developed, a part of the photoresist layer 3 corresponding to a concave portion of the photoresist layer 2 is removed by the development process. On the other hand, even if a photomask is set on the photoresist layer 3, a part of the photoresist layer 3 on the photoresist layer 2 is concaved only in a range of 1–5 μm. The reason for this is as follows. First, when the photoresist layer 3 is exposed, the surface on which the mask is set is irradiated by scattering of light on the photoresist layer 2. Second, as the photoresist layers 2 and 3 are directly in contact with each other, properties of the photoresist layer is chemically changed so that the layer is hardly removed by the development process.

That is, due to the metal layer 9 which is set between the photoresist layers 2 and 3, both the photoresist layers 2 and 3 are developed so that a predetermined shape thereof can be obtained. According to the process indicated in FIGS. 14A–14H, three dimensional structure can be accurately and easily formed by photolithography with respect to the photoresist multi-layers at a low cost.

A description will now be given of another embodiment of the ink jet recording head unit with reference to FIGS. 16A–16D.

Figure 16A:
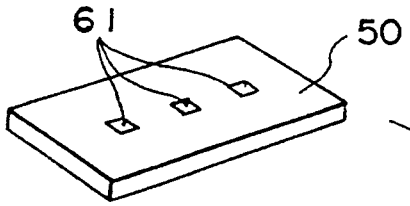
FIGS. 16A–16D are diagrams illustrating the structure of another recording head chip according to the present invention.
Figure 16B:
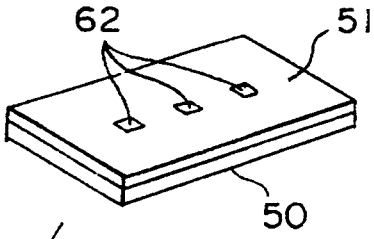
Figure 16C:
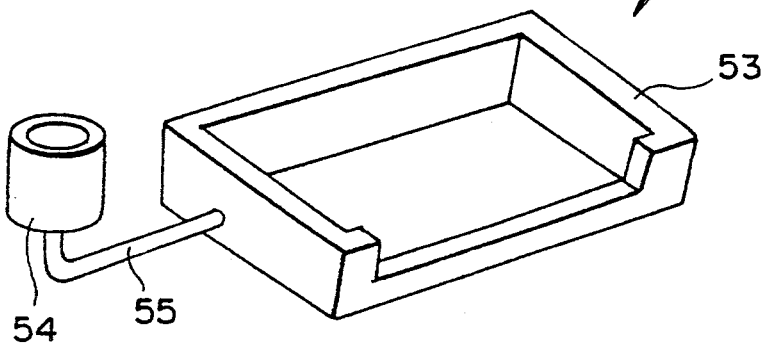
Figure 16D:
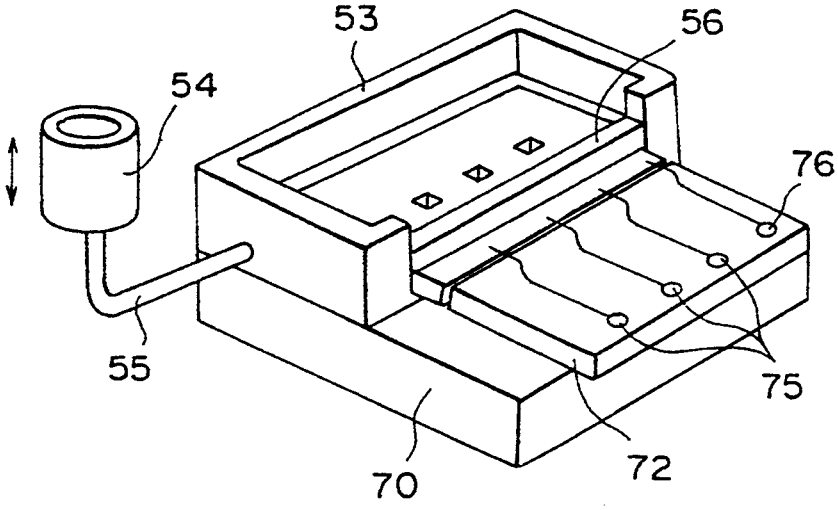

Referring to FIG. 16A–16C, heater elements 61 arranged in a line are formed on the surface of a substrate 50. An ink supply plate 51 made of a photoresist is adhered to the surface of the substrate 50. Pits 62 are formed on the ink supply plate 51 by the photolithography process, each pit corresponding to one of the heater elements 61 on the substrate 50. The stacked structure of the substrate 50 and the ink supply plate 51 is set in an ink accumulating portion of an ink supplier 53. An ink reservoir tank 54 is connected to the ink supplier 53 via an ink supply tube 55. The ink supplier 53 is mounted on a base plate 70 as shown in FIG. 16D, and the heater elements 61 on the substrate 50 are connected to a printed circuit board 72 which is mounted on the base plate 70. A frame 56 is provided in the ink accumulating portion of the ink supplier 53 so that the ink in the ink accumulating portion is prevented from coming out of the ink supplier 53. A printing line pattern, control electrodes 75, an earth electrode and the like are formed on the printing circuit board 72. In the ink jet recording head unit having the above structure, the depth of the ink layer on each of the heater elements 61 is controlled by moving the reservoir tank 54 upward and downward as indicated by an arrow in FIG. 16D.

According to the ink jet recording head unit shown in FIGS. 16A–16D, as each of the heater elements 61 is provided in a corresponding one of the pits 62 so that each heater element 61 is surrounded by a wall of the corresponding one of the pits 62, a propulsion force generated by growth of the bubble can be transmitted accurately to the ink layer in a direction perpendicular to each of the heater elements 61. Thus, the ink drops can be stably jetted from the ink jet recording head unit.

Figure 17:
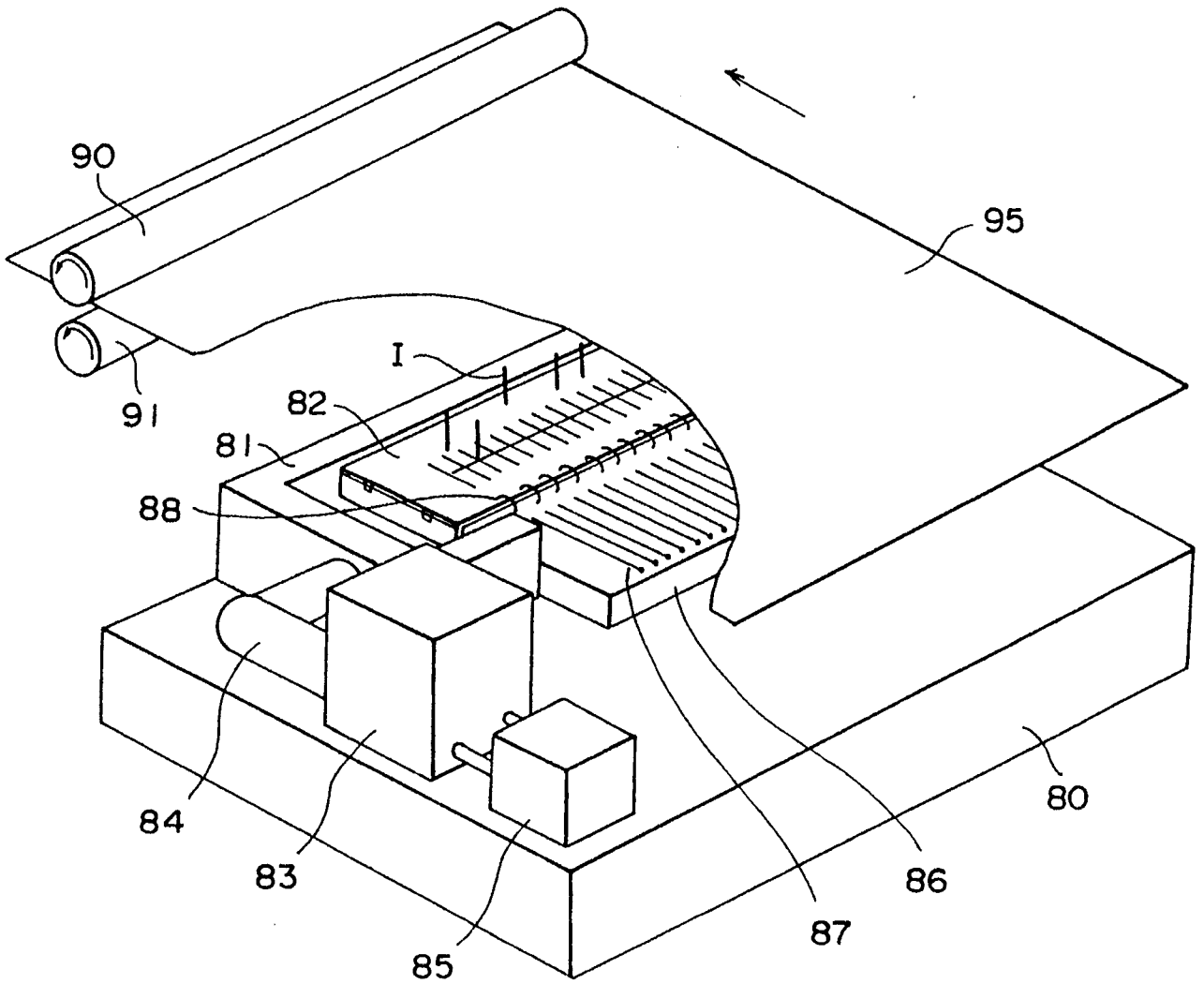
FIG. 17 is a perspective view illustrating an ink jet printer including an ink jet recording head according to the present invention.

FIG. 17 shows an example of a printer using the ink jet recording head unit described above.

Referring to FIG. 17, a recording head assembly, a level controller 83, a ink supply tube 84 and a pump 85 are mounted on a base plate 80. The level controller 83 has a mechanism as shown in FIG. 12 so that the surface of the ink in the recording head assembly is automatically controlled at a constant level. The recording head assembly has an ink accumulator 81 for accumulating the ink, a recording head chip 82 mounted in the ink accumulator 81 and a printed circuit board 86 having a connector 87. The recording head chip 82 and the printed circuit board 86 are electrically connected to each other by wire bonding. A recording sheet 95 facing the recording head chip 81 is fed in a direction parallel to the surface of the recording head chip 81 by rotation of rollers 90 and 91. The ink drops jetted from the recording head chip 81 are adhered to the surface of the recording sheet 95 which is fed at a constant speed, so that a dot image is formed on the recording sheet 95.

The present invention is not limited to the aforementioned embodiments, and variations and modifications may be made without departing from the scope of the claimed invention.

What is claimed is:

1. An ink jet recording head assembly comprising:

a base member having a plurality of enclosures, a top of each of said enclosures having an Opening;

an ink supply for supplying ink to each of said enclosures via the opening at the top thereof and for maintaining the ink at a predetermined depth; and an energy operation portion which is provided in each of said enclosures under the ink supplied via the opening, said energy operation portion supplying energy to the ink in each of said enclosures so that a bubble is generated in the ink.

wherein an ink drop is jetted from a surface of the ink due to the bubble generated in the ink, and wherein said ink supply has a plate on which a channel is formed, said plate being stacked on said base member so that ink flows through the channel and is supplied to each of said enclosures via the opening at the top thereof, a top surface of said channel being open.

2. An ink jet recording head assembly as claimed in claim 1, wherein said base member comprises a substrate and a first layer stacked on said substrate, said first layer having a plurality of pits corresponding to said plurality of enclosures.

3. An ink jet recording head assembly as claimed in claim 1, wherein said energy operation portion has an heater element which is heated by a driving pulse signal supplied thereto.

4. An ink jet recording head assembly as claimed in claim 3, wherein the driving pulse signal has a cycle equal to or greater than $(t+30)$ μsec. where t is a half width of an energy pulse supplied from said heater element.

5. An ink jet recording head assembly as claimed in claim 1, wherein the ink has an original depth which is equal to or greater than 0.8 times a height of the bubble generated in the ink.

6. An ink jet recording head assembly as claimed in claim 1, wherein the ink has an original depth which is equal to or less than a length of a column projecting from the surface of the ink when the bubble grows in the ink in each of said enclosures.

7. An ink jet recording head assembly as claimed in claim 1, wherein the ink has a depth which depends on a first depth of said channel and a second depth of each of said plurality of enclosures.

8. An ink jet recording head assembly as claimed in claim 1, wherein a relationship between sizes of each of said enclosures and said energy operation portion satisfies the following formula;

$S_h \leqq S_p < 2.55_h$ where $S_h$ is an area of said energy operation portion and $S_p$ is an area of a cross section of each of said enclosures in a plane parallel to said energy operation portion.

9. An ink jet recording head assembly as claimed in claim 1, wherein said ink supply further comprises a control circuit for controlling a level of the surface of the ink.

10. An ink jet recording head assembly as claimed in claim 9, wherein said control circuit comprises a reservoir tank provided with the ink and a tube connecting the ink in said reservoir tank to the ink on said base member, so that the level of the surface of the ink on said base member is controlled based on a difference between a water head of the ink in said reservoir tank and that of the ink on said base member.

11. An ink jet recording head assembly comprising:

a base member having a plurality of enclosures, a top of each of said enclosures having an opening:

an ink supplying plate formed on said base member, said ink supplying plate having an ink channel with an open top and at least one groove connected to said ink channel, said ink channel being coupled to said enclosures via the openings at the top thereof so that ink is supplied from an external ink supply unit to said enclosures via said at least one groove in such a manner that the ink is maintained at a predetermined depth; and an energy operation portion which is provided in each of said enclosures under the ink supplied via the opening, said energy operation portion supplying energy to the ink in each of said enclosures so that a bubble is generated in the ink, wherein an ink drop is jetted by growth of the bubble from a surface of the ink.

12. An ink jet recording head assembly as claimed in claim 11, wherein said base member comprises a substrate and first layer stacked on said substrate, said first layer having a plurality of pits corresponding to said plurality of enclosures.

13. An ink jet recording head assembly as claimed in claim 11, wherein said energy operation portion has an heater element which is heated by a driving pulse signal supplied thereto.

14. An ink jet recording head assembly as claimed in claim 13, wherein the driving pulse signal has a cycle equal to or greater than (t+30) μsec. where t is a half width of an energy pulse supplied from said heater element.

15. An ink jet recording head assembly as claimed in claim 11, wherein the ink has an original depth which is equal to or less than a length of a column projecting from the surface of the ink when the bubble grows in the ink in each of said enclosures and wherein a relationship between sizes of each of said enclosures and said energy operation portion satisfies the following formula;

$S_h \leqq S_p < 2.55_h$ where $S_h$ is an area of said energy operation portion and $S_p$ is an area of a cross section of each of said enclosures in a plane parallel to said energy operation portion.

16. An ink jet recording head assembly as claimed in claim 11, said means for supplying the ink to each of said enclosures having a plate on which a channel is formed, said plate being stacked on said base member so that the ink flows through the channel and is supplied to each of said enclosures via the openings at the top thereof.

17. An ink jet recording head assembly as claimed in claim 16, wherein the ink has a depth which depends on a first depth of said channel and a second depth of each of said enclosures.

18. An ink jet recording head assembly as claimed in claim 11, further comprising control means for controlling a level of the surface of the ink.

19. An ink jet recording head assembly as claimed in claim 18, wherein said control means comprises a reservoir tank provided with the ink and a tube connecting said reservoir tank to said base member, so that the level of the surface of the ink on said base member is controlled based on a difference between a water head of the ink in said reservoir tank and that of the ink on said base member.

* * * * *